US008786536B2

(12) United States Patent
Kim

(10) Patent No.: US 8,786,536 B2
(45) Date of Patent: Jul. 22, 2014

(54) LIQUID CRYSTAL DISPLAY HAVING LINE DRIVERS WITH REDUCED NEED FOR WIDE BANDWIDTH SWITCHING

(75) Inventor: Dong-Gyu Kim, Yongin-si (KR)

(73) Assignee: Samsung Display Co., Ltd. (KR)

( * ) Notice: Subject to any disclaimer, the term of this patent is extended or adjusted under 35 U.S.C. 154(b) by 1032 days.

(21) Appl. No.: 11/782,338

(22) Filed: Jul. 24, 2007

(65) Prior Publication Data

US 2008/0024418 A1 Jan. 31, 2008

(30) Foreign Application Priority Data

Jul. 25, 2006 (KR) ..... 10-2006-0069669

(51) Int. Cl.
*G09G 3/36* (2006.01)

(52) U.S. Cl.
USPC ..... 345/100

(58) Field of Classification Search
CPC ..... G09G 3/3677; G09G 2310/0286; G09G 2310/0281; G09G 2310/0251
USPC ..... 345/98–100
See application file for complete search history.

(56) References Cited

U.S. PATENT DOCUMENTS

| | | | | |
|---|---|---|---|---|
| 5,790,089 | A * | 8/1998 | Ono et al. | 345/94 |
| 6,246,385 | B1 | 6/2001 | Kinoshita et al. | |
| 6,545,653 | B1 * | 4/2003 | Takahara et al. | 345/100 |
| 6,894,667 | B1 * | 5/2005 | Lin | 345/100 |
| 7,382,346 | B2 * | 6/2008 | Moon | 345/100 |
| 7,477,224 | B2 * | 1/2009 | Song et al. | 345/98 |
| 7,586,476 | B2 * | 9/2009 | Kwon et al. | 345/100 |
| 7,705,820 | B2 * | 4/2010 | Park | 345/100 |
| 8,179,355 | B2 * | 5/2012 | Lee et al. | 345/99 |
| 2002/0044127 | A1 | 4/2002 | Uchino et al. | |
| 2002/0180902 | A1 * | 12/2002 | Izumi et al. | 349/43 |
| 2005/0078076 | A1 * | 4/2005 | Kim et al. | 345/98 |
| 2006/0061535 | A1 | 3/2006 | Kim et al. | |
| 2006/0145998 | A1 * | 7/2006 | Cho et al. | 345/100 |
| 2006/0284815 | A1 * | 12/2006 | Kwon et al. | 345/98 |
| 2007/0080905 | A1 * | 4/2007 | Takahara | 345/76 |
| 2008/0012819 | A1 * | 1/2008 | Lee et al. | 345/100 |

FOREIGN PATENT DOCUMENTS

| | | |
|---|---|---|
| JP | 7-043675 | 2/1995 |
| JP | 10-228263 | 8/1998 |
| JP | 11-119742 | 4/1999 |
| JP | 11-126051 | 5/1999 |

(Continued)

OTHER PUBLICATIONS

English Language Abstract, KR Patent Publication No. 2006-0071016, Jun. 26, 2006, 1 page.

(Continued)

*Primary Examiner* — Allison W Johnson
(74) *Attorney, Agent, or Firm* — Innovation Counsel LLP

(57) ABSTRACT

A liquid crystal display includes a substrate, a plurality of gate lines formed on the substrate, a plurality of data lines intersecting the gate lines, a plurality of thin film transistors connected to the gate lines and the data lines, a plurality of pixel electrodes connected to the thin film transistors and including a first edge parallel to the gate line and a second edge that is shorter than the first edge and is next to the first edge, and at least two gate drivers connected to mutually exclusive, interlaced subsets of the gate lines. The gate drivers may include the first gate driving circuit and the second gate driving circuit disposed opposite to each other with respect to the substrate.

19 Claims, 9 Drawing Sheets

(56) References Cited

FOREIGN PATENT DOCUMENTS

| | | |
|---|---|---|
| JP | 11-133930 | 5/1999 |
| JP | 2950808 | 7/1999 |
| JP | 2002-162941 | 6/2002 |
| JP | 2003-255907 | 9/2003 |
| KR | 1998-081805 | 11/1998 |
| KR | 2005-0000105 | 1/2005 |
| KR | 2005-0077573 | 8/2005 |
| KR | 2006-0018002 | 2/2006 |
| KR | 2006-0027593 | 3/2006 |
| KR | 2006-0029369 | 4/2006 |
| KR | 2006-0037515 | 5/2006 |
| KR | 2006-0037898 | 5/2006 |
| KR | 2006-0071016 | 6/2006 |

OTHER PUBLICATIONS

English Language Abstract, KR Patent Publication No. 2006-0037898, May 3, 2006, 1 page.

English Language Abstract, KR Patent Publication No. 2006-0037515, May 3, 2006, 1 page.

English Language Abstract, KR Patent Publication No. 2006-0029369, Apr. 6, 2006, 1 page.

English Language Abstract, KR Patent Publication No. 2006-0027593, Mar. 28, 2006, 1 page.

English Language Abstract, KR Patent Publication No. 2006-0018002, Feb. 28, 2006, 1 page.

English Language Abstract, KR Patent Publication No. 2005-0077573, Aug. 3, 2005, 1 page.

English Language Abstract, KR Patent Publication No. 2005-0000105, Jan. 3, 2005, 1 page.

English Language Abstract, KR Patent Publication No. 1998-081805, Nov. 25, 1998, 1 page.

English Language Abstract, JP Patent Publication No. 2003-255907, Sep. 10, 2003, 1 page.

English Language Abstract, JP Patent Publication No. 2002-162941, Jun. 7, 2002, 1 page.

English Language Abstract, JP Patent Publication No. 2950808, Jul. 9, 1999, 1 page.

English Language Abstract, JP Patent Publication No. 11-133930, May 21, 1999, 1 page.

English Language Abstract, JP Patent Publication No. 07-043675, Feb. 14, 1995, 1 page.

* cited by examiner

LIQUID CRYSTAL DISPLAY HAVING LINE DRIVERS WITH REDUCED NEED FOR WIDE BANDWIDTH SWITCHING

CROSS-REFERENCE TO RELATED APPLICATION

This application claims priority to and benefit of Korean Patent Application No. 10-2006-0069669 filed in the Korean Intellectual Property Office on Jul. 25, 2006, the entire disclosure of which is incorporated herein by reference.

BACKGROUND (a) Field of Invention

The present disclosure of invention relates to liquid crystal displays (LCDs) and more specifically to wide screen LCDs in which long gate lines may appear as slow RC delay lines.

(b) Description of the Related Art

Liquid crystal displays (LCDs) are one of the most widely used flat panel displays. They may be found in a variety of applications, including high resolution computer monitors and wide-screen high definition television displays. An LCD typically includes two spaced-apart panels provided with opposed field-generating electrodes between which electric fields are generated for changing orientation of liquid crystal material interposed between the panels. The opposed electrodes are often referred to as pixel electrodes on one panel and a common electrode on the other panel, where the liquid crystal material layer is interposed therebetween. An LCD typically displays images by applying different voltages to the pixel-electrodes so as to thereby generate different electric fields passing through the liquid crystal layer, and thereby determining the orientations of the liquid crystal molecules in the liquid crystal layer and adjusting polarization of passing-through light.

An LCD also typically includes on one of its panels, a plurality of switching elements connected to respective ones of the pixel electrodes, and a plurality of signal lines such as gate lines and data lines operatively coupled to the switching elements (e.g., TFTs or thin film transistors) for respectively gating the switching elements and for passing through data voltages that are to be used to charge the corresponding pixel electrodes.

The gate lines and data lines are structure driven by gate driving circuits and the data driving circuits where the latter may be implemented as a plurality of monolithic integrated circuit (IC) chips directly mounted on the panel that contains the switching elements (e.g., TFTs) or mounted on a flexible printed circuit film which attaches to the panel. It is common for these gate and data signal driving IC chips to take up a large part of the manufacturing cost of an LCD. Particularly, since the cost of an analog data driving IC chip is very high compared to the cost of a digital gate driving circuit chip, it would be advantageous if the number of and/or required switching speeds of analog data driving IC chips can be decreased, especially in the case of a large-sized LCDs (e.g., wide screen LCDs) having high resolution. The cost of the digital gate driving circuit can be reduced by integrating the circuitry of that gate driving circuit into the TFT panel substrate together with the gate lines, the data lines, and the panel's switching elements (TFT's). However, as for the analog data driving circuits, because they typically have a different IC fabrication technology, it is hard to integrate the analog data driving circuits into the TFT panel substrate due to the more complex structure of the analog circuitry and thus it is all the more desirable to reduce the number of and/or required switching speeds of IC chips used to implement the analog data driving circuits due to cost considerations.

In the case of wide-area, high definition LCDs there is another concomitant problem. The gate and data lines which couple to distributed switching elements across the wide-area LCD are relatively narrow and thus appear to function as RC delay lines that deliver signals of smaller size and greater delay to switching elements further downstream on the line away from the signal driving circuit. Due to the uneven distribution of signal strength and signal arrival time across the display area, the image quality of the LCD may be deteriorated. This problem gets worse as the signal switching bandwidth required along all points on each RC-type delay line grows.

The above information disclosed in this Background section is only for enhancement of understanding of the motivations that drive the present disclosure of invention and therefore the above information (alone or in combination) may contain information that does not form part of the prior art as known to persons of ordinary skill in the art prior to public release of this disclosure.

SUMMARY

A liquid crystal display according to an exemplary embodiment of the present disclosure includes a TFT-containing substrate, a plurality of gate lines integrally formed on the substrate, a plurality of data lines intersecting the gate lines, a plurality of thin film transistors (TFTs) connected to the gate lines and to the data lines, a plurality of pixel electrodes connected to the thin film transistors, where each pixel-electrode has a shape of a parallelogram (e.g., a rectangle) with corresponding pairs of parallel sides or edges including a relatively long first edge that is parallel to a corresponding gate line and a relatively short second edge that is parallel to a corresponding data line, where the second edge is substantially shorter than the first edge (e.g., 66% or more times shorter), and where at least two gate drivers connect to opposed ends of the gate lines so as to thereby reduce signal delay time to pixels positioned at distributed points along the length of each gate line. The gate drivers may include a first gate driving circuit portion and a second gate driving circuit portion disposed on or near opposite edges of the TFT-containing substrate but simultaneously applying essentially same voltage waveforms to opposed end portions of the corresponding gate line.

In one embodiment, the gate drivers include a first gate driver connected to a first subset of the gate lines and a second gate driver connected to a mutually exclusive other subset of the gate lines. The first gate driver may be connected to odd numbered gate lines, and the second gate driver may be connected to even numbered gate lines. The first and second gate drivers supply turn-on gate voltage pulses to selected ones of gate lines in their respective subsets where the turn-on gate voltage pulses of the first and second gate drivers can overlap each other on the time line.

In one embodiment, the gate drivers may include a first gate driver connected to a first subset of the gate lines, a second gate driver connected to a second subset of the gate lines, and a third gate driver connected to a third subset of the gate lines. The first to third gate drivers may be sequentially connected to different ones of consecutive gate lines. The first through third gate drivers supply turn-on gate voltage pulses to selected ones of gate lines in their respective subsets where the turn-on gate voltage pulses of the first through third gate drivers can overlap one to the next with each other on the time line.

In one embodiment, the gate drivers are located in the same layer as the gate lines, the data lines, and the thin film transistors.

In one embodiment, the length of the first edge is at least about three times the length of the second edge.

In one embodiment, the thin film transistors adjacent to each other in a column direction, with an odd-numbered data line disposed for example to the left of the column and an even-numbered data line disposed for example to the right of the column, may be alternatingly connected to the left and right side data lines with alternation of connection occurring every two rows for example.

In one embodiment, the gate lines are supplied with gate line driving signals including transitions between a gate-on voltage and a gate-off voltage, where the gate-on voltage level is maintained for more than 1 horizontal scan period. In one embodiment, the gate-on voltage level is maintained for about 2 horizontal periods.

The continuous durations of the gate-on voltages of two respective gate driving signals applied respectively to two gate lines adjacent to each other may overlap with each other on the time line. The durations of the gate-on voltages of the two overlapping gate driving signals applied to two gate lines adjacent to each other may overlap each other for a line pre-charging period of about 1 horizontal scan period or less.

In another embodiment, the gate lines are supplied with gate line driving signals including transitions between a gate-on voltage and a gate-off voltage, where the gate-on voltage level is maintained for more than 2 horizontal scan periods. In one embodiment, the gate-on voltage level is maintained for about 3 horizontal periods.

The continuous durations of the gate-on voltages of two respective gate driving signals applied respectively to two gate lines adjacent to each other may overlap with each other along the time line. The durations of the gate-on voltages of the two overlapping gate driving signals applied to two gate lines adjacent to each other may overlap each other for a line pre-charging period of about 2 horizontal scan period or less.

During a given display frame, each data line may respectively have data voltage signal applied to it where that in-frame data voltage signal has a single polarity (either positive or negative, including a possibility of a zero level in each of the two polarity ranges).

DETAILED DESCRIPTION

Figure 1:
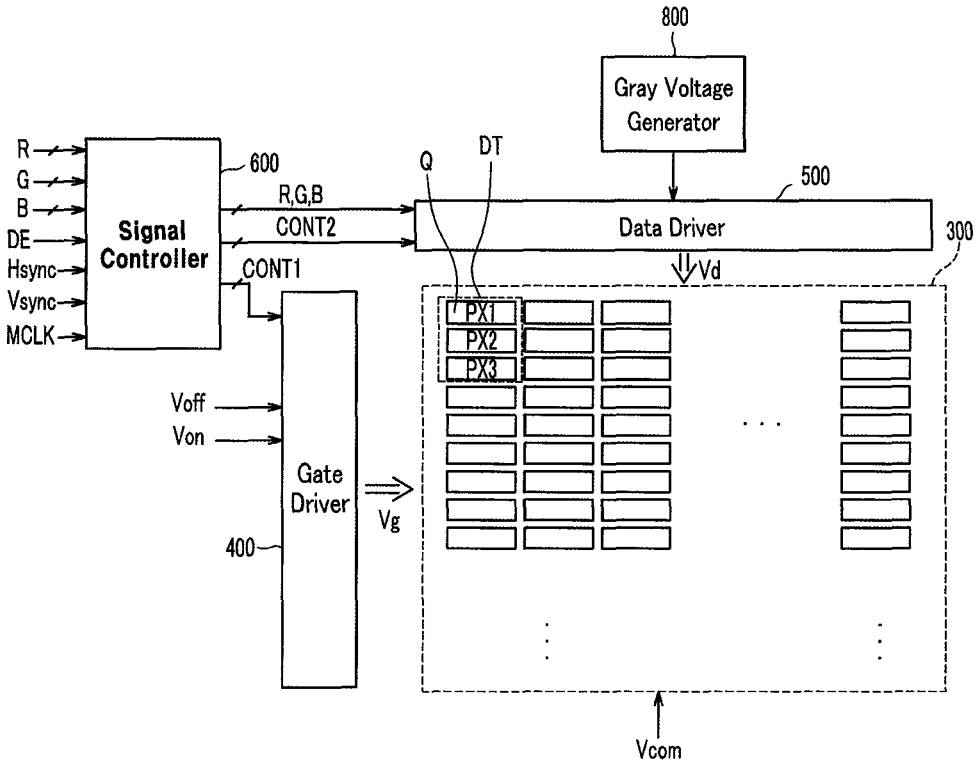
FIG. 1 is a block diagram of an LCD according to an exemplary first embodiment of the present disclosure.

Embodiments in accordance with the disclosure will be described more fully hereinafter with reference to the accompanying drawings.

After reading the disclosure, persons skilled in the art may realize that the described embodiments can be modified in various ways without departing from the spirit or scope of the present disclosure. Accordingly it is to be understood that the examples given here are not to be taken as limiting ones.

In the drawings, the thickness of layers, films, panels, regions, etc., may be exaggerated for clarity. Like reference numerals generally designate like elements throughout the specification. It will be understood that when an element such as a layer, film, region, or substrate is referred to as being "on" another element, it can be directly on the other element or intervening elements may also be present. In contrast, when an element is referred to as being "directly on" another element, there are no intervening elements present.

Now, a first LCD embodiment in accordance with the present disclosure will be described in detail with reference to FIG. 1 and FIG. 2.

Figure 2:
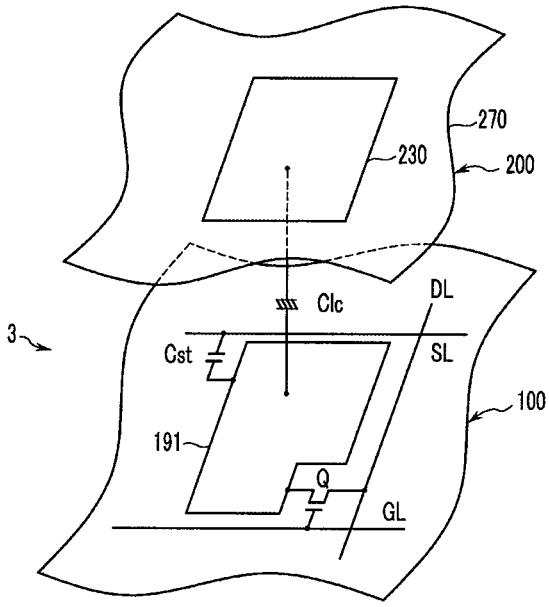
FIG. 2 is an equivalent circuit diagram of a pixel of an LCD according to an exemplary embodiment.

FIG. 1 is a block circuit diagram of the first LCD while FIG. 2 shows in perspective, an equivalent circuit diagram of a single pixel area of the first LCD. Referring to FIG. 1, the first LCD includes a multi-panel assembly 300, a gate driver 400 coupled to gate lines of assembly 300 and a data driver 500 coupled to data lines of assembly 300. The first LCD further includes a gray voltages generator 800 connected to the data driver 500, and a signal controller 600 for controlling and coordinating operations of the gate driver 400 and data driver 500.

The liquid crystal panels assembly 300 includes a plurality of display signal lines and a plurality of pixels PX1, PX2, and PX3 connected to the display signal lines and arranged substantially in a matrix having plural rows and plural columns as seen in FIG. 1 for example. More specifically, the liquid crystal panels assembly 300 includes a lower panel 100 and a spaced-apart upper panel 200 that face each other with a liquid crystal material layer 3 being interposed therebetween, as seen in a structural view illustrated in FIG. 2.

Still referring to FIG. 2, the signal lines include a plurality of gate lines GL for transmitting gate voltage signals, Vg (also referred to as "scanning signals") and a plurality of data lines DL for transmitting data voltage signals Vd. The gate lines GL extend substantially in a row direction (horizontally in FIG. 2) and are substantially parallel to each other. The data lines DL extend substantially in a column direction (vertically in FIG. 2) and are substantially parallel to each other.

Each pixel PX1, PX2, and PX3 has an elongated parallelogram shape with the longer sides (edges) extending in the row direction. Each pixel PX1, PX2, etc. is connected to a corresponding gate line GL (FIG. 2) and to a corresponding data line DL, and includes a switching element Q (e.g., a thin film MOSFET) connected to the signal lines GL and DL. Each pixel has a liquid crystal capacitance Clc defined therein between its pixel-electrode 191 and the common electrode 200 where the LC capacitance, Clc is coupled to the switching element Q. Each pixel may optionally have a storage capacitor Cst defined therein and also to the switching element Q (by way of the pixel-electrode 191 for example). The storage capacitor Cst may be omitted if desired.

In one embodiment, each switching element Q comprises a thin film transistor provided on the lower panel 100 and having three electrical terminals (source, drain, gate), wherein the control terminal (gate) thereof is connected to the gate line GL, the input terminal (source) thereof is connected to the data line DL, and the output terminal (drain) thereof is connected to the liquid crystal capacitor Clc and to the optional storage capacitor Cst.

As seen in FIG. 2, the liquid crystal capacitor Clc is defined by the pixel electrode 191 that is provided on the lower panel 100 and by an overlapping part (230) of the common electrode 270 provided on the upper panel 200, where the liquid crystal layer 3 disposed between the two electrodes 191 and 270 functions as a dielectric material of the liquid crystal capacitor Clc. The pixel electrode 191 is connected to the drain of the switching element Q. The common electrode 270 is formed on the entire surface of the upper panel 200 and supplied with a common voltage Vcom. Unlike FIG. 2, in an alternate embodiment, the common electrode 270 may be provided on the lower panel 100, and in this case, at least one of the two electrodes 191 and 270 may have shapes of stripes or bars.

The storage capacitor Cst, functions as an auxiliary capacitor for the liquid crystal capacitor Clc by storing charge between the pixel-electrode and a storage line, SL. In one embodiment, the storage capacitor Cst is formed by overlapping the storage electrode line SL with a pixel electrode 191 where an insulator is disposed therebetween. The storage electrode line SL is supplied with a predetermined voltage such as the common voltage Vcom. Alternatively, the storage capacitor Cst may be formed by overlapping a pixel electrode 191 with the previous gate line right above it with an insulator being interposed between the electrodes that define the capacitor plates.

In the meantime, in order to implement color display, each pixel PX1-PX3 uniquely displays one of the primary colors (spatial division) or each pixel PX1-PX3 sequentially displays the primary colors in turn (temporal division) so that a spatial or temporal sum of the primary colors are recognized as a desired color. An example of a set of the primary colors is three primary colors including red, green, and blue.

FIG. 2 shows an example of the spatial division embodiment in which each pixel PX1-PX3 includes a respective mono-chromic color filter 230 such as one representing one of the primary colors in an area of the upper panel 200 facing the pixel electrode 191. Unlike FIG. 2, in an alternate embodiment, the color filter 230 may be provided on or under the pixel electrode 191 on the lower panel 100. In one embodiment, color filters 230 of the pixels PX1, PX1*b*, PX1*c*, etc. (not all so labeled, but understood to be in row 1) that are adjacent to each other in a row direction are of a same color and are contiguously connected to each other to extend along the row direction, and color filters 230 representing different colors from each other are arranged alternately in the column direction.

Hereinafter, it is assumed that each color filter 230 represents any one of red, green, and blue colors, and a pixel including a red color filter 230 is referred to as a red pixel, a pixel including a green color filter 230 is referred to as a green pixel, and a pixel including a blue color filter 230 is referred to as a blue pixel. Red pixels, blue pixels, and green pixels are disposed sequentially and alternately in the column direction.

In this way, pixels PX1-PX3 representing three primary colors form a colorable dot DT that is a fundamental unit for displaying color images. In the case where the aspect ratio of each pixel-electrode is about 3:1, the colorable dot DT may have a generally square shape.

Referring to FIG. 1 again, in one embodiment, the gate driver circuitry 400 is integrated into the liquid crystal panels assembly 300 along with the signal lines GL, DL, and SL and the thin film transistor switching elements Q, where the gate driver circuitry 400 is located on one side of one panel (e.g., 100) of the liquid crystal multi-panel assembly 300. However in an alternate embodiment, the gate driver 400 may include a plurality of gate drivers (not shown) and they may be located on both sides with respect to a panel of the liquid crystal panels assembly 300. The gate driver 400 supplies the gate signals Vg including a gate-on activating voltage Von and a gate-off deactivating voltage Voff to the gate lines GL. The gate driver circuitry 400 may be directly mounted on the assembly 300 in the form of plural IC chips, and/or they may be mounted on a flexible printed circuit film (not shown) to be attached to the liquid crystal panel assembly 300 in a tape carrier package (TCP) form, or they may be mounted on a separate printed circuit board (PCB) (not shown).

At least one polarizer (not shown) for polarizing light is typically attached on an outer surface of the liquid crystal panels assembly 300.

The gray voltages generator 800 typically generates two sets of gray voltage spectrums (or reference gray voltages) related to the light transmittance amount of each of the pixels PX1-PX3. Gray voltages of one set each have a positive value with respect to the common voltage Vcom, while gray voltages of the other set each have a negative value with respect to the common voltage Vcom. Deleterious effects of unidirectional can be avoided by switching periodically between the positive and negative drive sets.

The data driver 500 is connected to the data lines DL of the liquid crystal panels assembly 300, and applies data voltage signals Vd selected from the current spectrum of gray voltages that is supplied at the time from the gray voltages generator 800 to the data lines DL. In one alternate embodiment, the gray voltages generator 800 does not supply voltages for the full spectrum of usable grays but rather supplies only a smaller number of reference gray voltages, where the smaller number is predetermined. In such a case, the data driver 500 extrapolates between the supplied reference gray voltages to thereby generate gray voltages for all the usable grays and selects desired data signals from the extrapolation-wise generated gray voltages. The data driver 500 may be directly mounted on the liquid crystal panels assembly 300 in the form of IC chips, it may be mounted on a flexible printed circuit film (not shown) to be attached to the liquid crystal panel assembly 300 in a tape carrier package (TCP) form, or it may be mounted on a separate printed circuit board (PCB) (not shown). Alternatively, it may be integrated into the liquid crystal panels assembly 300 along with the signal lines GL, DL, and SL and thin film transistor switching elements Q.

The signal controller 600 controls the gate drivers 400 and the data driver 500.

Now, the operation of the first LCD will be described in yet greater detail. The signal controller 600 is supplied with input image signals R, G, and B and input control signals for controlling the display of the input image signals R, G, and B from an external graphics controller (not shown). The input image signals R, G, and B include luminance information for respectively colored ones of the pixels PX1, PX2, etc. In one embodiment, the luminance information has a predetermined number of discrete values, for example, 1024($=2^{10}$), 256($=2^{8}$), or 64($=2^{6}$) gray levels. The input control signals include, for example, a vertical synchronization signal Vsync, a horizontal synchronization signal Hsync, a main clock signal MCLK, and a data enable signal DE.

On the basis of the input control signals and the input image signals R, G, and B, the signal controller 600 appropriately processes the input image signals R, G, and B for the operating conditions of the liquid crystal panel assembly 300 and generates gate control signals CONT1 and data control signals CONT2. Then, the signal controller 600 transmits the gate control signals CONT1 to the gate driver 400 and transmits the processed image signals DAT (R,G,B) and the data control signals CONT2 to the data driver 500. The processing of image signals by the signal controller 600 may include an operation of rearranging the input image signals R, G, and B according to the disposition of the corresponding colored pixels PX on assembly 300.

The gate control signals CONT1 include a scanning start signal STV for instructing to start scanning and at least one clock signal for controlling the output time of the gate-on voltage Von. The gate control signals CONT1 may further include an output enable signal OE for defining the duration of the gate-on voltage Von.

The data control signals CONT2 include a horizontal synchronization start signal STH for informing of a start of digital image signal DAT transmission for a row of pixels, a load signal LOAD for instructing to apply analog data signals to the data lines D1-Dm, and a data clock signal HCLK. The data control signals CONT2 may further include a inversion signal RVS for selectively reversing the voltage polarity of the analog data signals with respect to the common voltage Vcom (hereinafter, the "voltage polarity of the data signals with respect to the common voltage Vcom" is referred to as "polarity of the data signals").

In responding to the data control signals CONT2 from the signal controller 600, the data driver 500 sequentially receives the digital image signals DAT for a given row of pixels PX and selects gray voltages corresponding to the respective digital image signals DAT, thereby converting the digital image signals DAT into corresponding analog data signals, which are then applied to the corresponding data lines DL.

The gate driver 400 applies the gate-on voltage Von to a selected one or more of the gate lines G1-Gn whose row/rows is/are currently active in response to the gate control signals CONT1 received from the signal controller 600, thereby turning on (rendering conductive) the switching elements Q connected to the gate lines GL receiving the Von voltage. Then, data signals applied to the data lines DL are applied to the corresponding pixels PX through the turned-on switching elements Q.

The difference between the voltage of the data signal applied to the pixel PX and the common voltage Vcom generates a corresponding charged voltage of the liquid crystal capacitor Clc, that is also referred to here as the pixel voltage. The arrangement of the liquid crystal molecules varies depending on the intensity of their respective pixel voltages, and thus the polarization of light passing through the liquid crystal layer 3 varies. This variation of the light polarization causes a change of light transmittance by the polarizers attached to the liquid crystal panel assembly 300, and in this way, the pixels PX display images having the luminance represented by the grays of the image signals DAT.

By repeating this procedure by a unit of the horizontal drive period (which is also denoted as "1H" and is equal to one period of the horizontal synchronization signal Hsync and the data enable signal DE), all gate lines GL may be sequentially supplied with the gate-on voltage Von, thereby applying desired data signals to all pixels PX to display an image for a corresponding frame.

When one frame is finished, the next frame starts, and the inversion signal RVS may be applied to the data driver 500 such that the polarity of the data signals applied to the respective pixels PX is reversed to be opposite to the polarity in the previous frame (which is referred to as "frame inversion"). In one embodiment, even within one frame, the polarity of the data signals flowing in a data line may vary (for example, per-row inversion and/or per dot inversion) or the polarities of the data signals applied to the pixels in a row may be caused to be different from each other (for example, column inversion and dot inversion) in accordance with the characteristics of the inversion signal RVS.

Now, the liquid crystal panel assembly 300 and the gate driver 400 according to an embodiment will be described in further detail with reference to FIG. 3 and FIG. 4.

Figure 3:
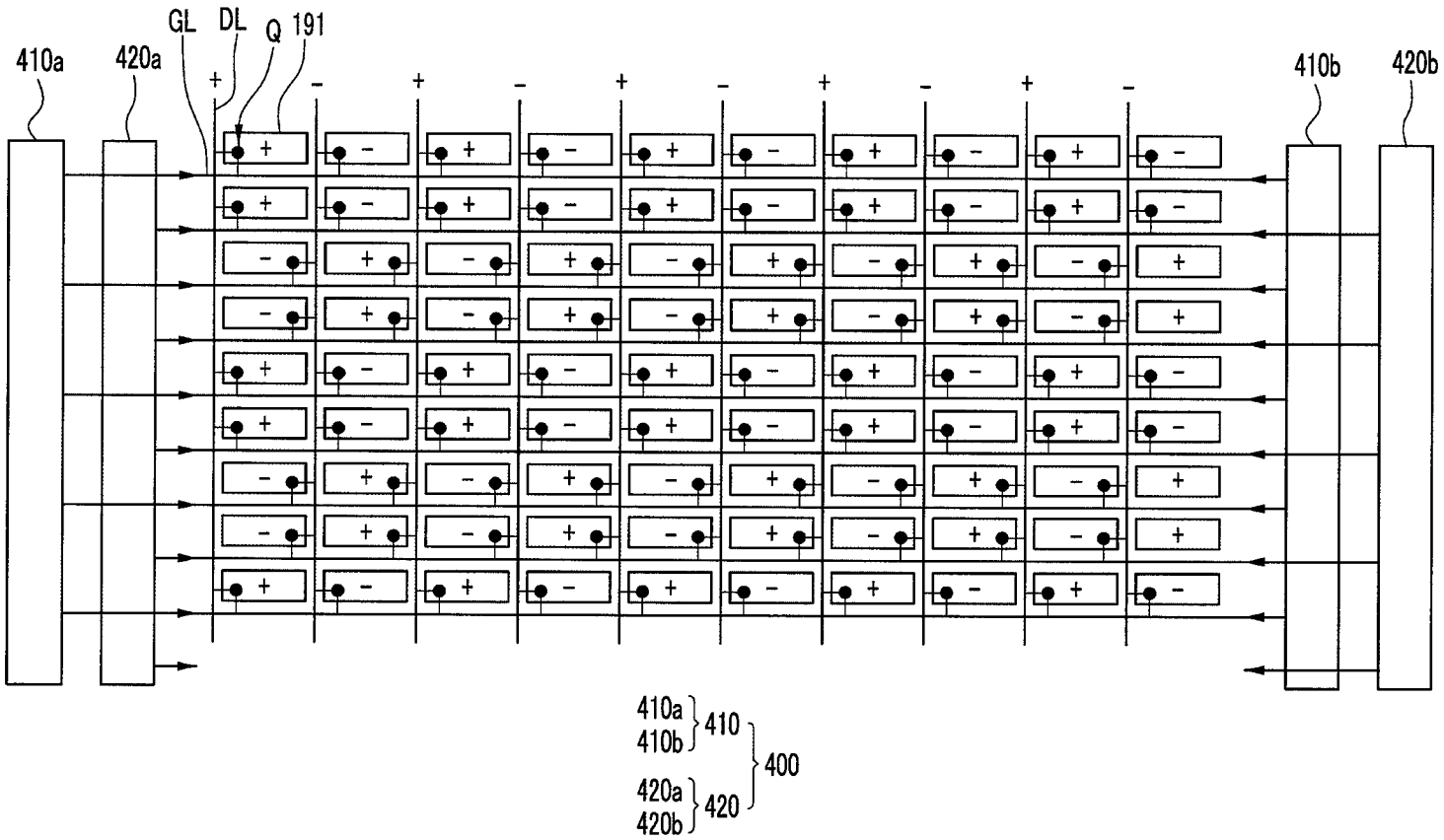
FIG. 3 is a layout view representing arrangement of a pixel and a gate driver for an LCD according to an exemplary embodiment.
Figure 4:
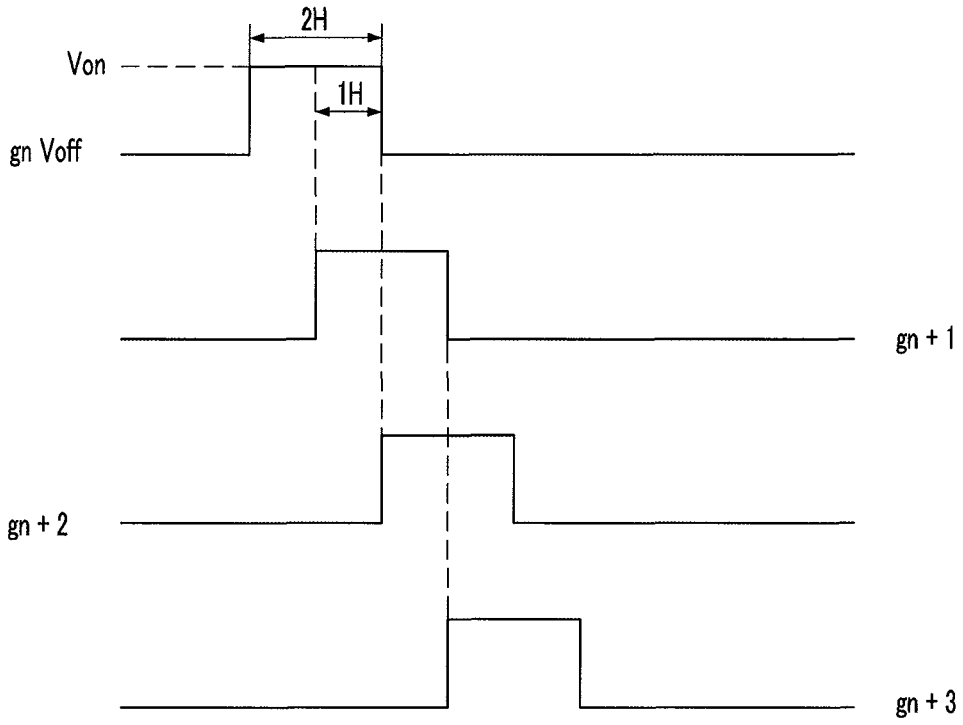
FIG. 4 is a waveform diagram showing a plurality of gate line driving signals being applied over time to sequential ones of gate lines in the liquid crystal display of FIG. 3 where the continuous turn-on levels of the gate line driving signals overlap one to the next with each other over the time line.

FIG. 3 is a layout view representing arrangement of a pixel and a gate driver for an LCD according to an exemplary embodiment. In the embodiment of FIG. 3, data voltages applied to two data lines DL adjacent to each other in column direction have an opposite polarity (plus (+) versus minus (−)) relative to each other. For example, in the data voltages respectively applied to two data lines DL across the pixel electrode denoted as 191, the data voltage applied to the left data line has a positive (+) polarity and the data voltage applied to the right data line has a negative (−) polarity.

The connection between the switching elements Q in the pixels PX and the data lines DL is varied every two pixels in the row direction. The switching elements Q are alternatively connected to the opposite sided data lines every two pixels when inspected in the row direction.

As illustrated in FIG. 3, when two adjacent pixels in each column are connected to the opposite polarity data lines, this happening every two pixels in the row direction, the polarities of pixel voltages for adjacent pixels (i.e., PX1, PX2, and PX3) inspected in the row direction are opposite to each other provided the data driver 500 applies data voltages having opposite polarities to the adjacent data lines in the form of column inversion while the polarities remain unchanged during a given frame. That is, the apparent inversion appearing on the screen during a given frame corresponds to a dot-area (DT) checkerboard inversion scheme. More specifically, a first dot area (DT) is a first column may have the three polarity sequence: +,+,− while a first dot area (DT) is an adjacent second column may have the three polarity sequence: −,−,+. Moreover a second dot area (DT) of the first column may have the three polarity sequence: −,−,+ while a second dot area (DT) of the second column may have the opposite three polarity sequence: +,+,−.

Other than for per frame inversion, the data driver 500 maintains the same checkerboard reversal of voltage polarities for the remaining ones of the adjacent data lines during each given frame.

Since the connections between the pixels and the data lines DL switch every two rows as shown in FIG. 3, the polarity inversion pattern generated by the data driver 500 on each one data line (DL) is different from the sequence of voltage polarities seen by looking down a corresponding column of pixels on the panel assembly 300. Hereinafter, the polarity inversion provided by the data driver 500 is referred to as "driver inversion" and the polarity inversion appearing on the panel assembly 300 is referred to as "apparent inversion." In one embodiment, the driver inversion is akin to column inversion while the apparent inversion is akin to 2+1 pixel inversion as shown in FIG. 3.

In the art of liquid crystal displays (LCDs) there is a problem known as kickback voltage difference. Kickback voltage difference can create a visual artifact wherein vertical flickering may be seen due to kickback voltage differences developed across the display. However, when the apparent inversion is of the dot inversion kind, luminance differences due to the difference of kickback voltages between dots whose pixel voltages have pixel voltages of opposite polarities may be dispersed to thereby reduce the vertical flickering artifact that is generally attributed to kickback voltage effects.

When the driver inversion is of the column inversion kind, then the polarity of the data voltages applied along each data line DL during one frame is the same; in other words not varied during the frame period and this nonvariance per frame lets designers improve the display resolution or increase the frame frequency without having to substantially increase the speed at which the analog data driver (500) delivers gray voltages of opposed polarity to the screen. Additionally, because the frequency of polarity reversal on each data line is kept low, signal modulation delay may be remarkably reduced and this can help to improve the charging of each pixel to its desired pixel voltage.

Each gate line GL is connected to the gate driver 400. The gate driver 400 includes a first gate driver 410 (having spaced-apart portions 410*a* and 410*b*) connected to odd numbered gate lines and a second gate driver 420 (having spaced-apart portions 420*a* and 420*b*) connected to even numbered gate lines. The odd numbered gate lines and the even numbered gate lines are thus sequentially and alternatively connected to the first gate driver 410 and the second gate driver 420.

As seen in FIG. 3, the first gate driver 410 includes a first gate driving circuit portion 410*a* and a second gate driving circuit portion 410*b* respectively disposed in spaced-apart relation near the left side and near the right side of the liquid crystal panels assembly 300. The first gate driving circuit portion 410*a* has its line drivers connected to the left end portions of the odd numbered gate lines GL, and the second gate driving circuit portion 410*b* has its line drivers connected to the right end portions of the odd numbered gate lines GL.

Similarly, the second gate driver 420 includes a third gate driving circuit portion 420*a* and a fourth gate driving circuit portion 420*b* respectively disposed in spaced-apart relation near the left side and the right side of the liquid crystal panel assembly 300. The third gate driving circuit portion 420*a* has its line drivers connected to the left end portions of the even numbered gate lines GL, and the fourth gate driving circuit portion 420*b* has its line drivers connected to the right end portions of the even numbered gate lines GL.

Accordingly, the first gate driving circuit portion 410*a* and the third gate driving circuit portion 420*a* are disposed at a same first side of the panel, and the second gate driving circuit portion 410*b* and the fourth gate driving circuit portion 420*b* are disposed at a same second side with respect to the liquid crystal panel assembly 300.

Now the gate signals according to the liquid crystal display shown in FIG. 3 will be described in detail with reference to FIG. 4. FIG. 4 is a waveform diagram of a gate signal applied to the liquid crystal display shown in FIG. 3. The gate driver 400 applies the gate signals including a gate-on voltage Von and a gate-off voltage Voff to each of consecutive gate lines GL1, GL2, GL3 as shown in FIG. 4.

In terms of more detail, the first gate driver 410 applies the gate signals to the odd numbered gate lines GL1, GL3, etc, and the second gate driver 420 applies the gate signals to the even numbered gate lines GL2, GL4, etc. Here, the first gate driving circuit portion 410*a* and the second gate driving circuit portion 410*b* of the first gate driver 410 simultaneously apply the same gate signals at the left side and the right side of the odd numbered gate lines GL, respectively, and the third gate driving circuit 420*a* and the fourth gate driving circuit 420*b* of the second gate driver 420 simultaneously apply the corresponding same gate signals at the left side and the right side of the even numbered gate lines GL, respectively.

The left portion and the right portion of the gate lines GL are close to the respective left and right circuit portions of gate driver 400, and thus the RC signal delay from the left and right circuit portions to transistors located near the left end portion and the right end portion of the gate lines GL is relatively small or insignificant. In addition to this, the signal delay in the middle portion of the gate lines GL may be made relatively small. Accordingly, deleterious effects of signal delay for gate signal pulses Vg may be prevented or minimized even though the gate lines GL may be relatively long such as in the case of wide screen displays.

Meanwhile, the duration of the gate-on signal pulses Von is longer than 1H, and in one embodiment it is about 2H. The reason why this can be so is because left side circuit portion 410*a* can continue to drive odd gate line GL1 even while left side circuit portion 420*a* begins to drive even gate line GL2. The pixel voltages captured by the pixel-electrodes of the transistors turned on along odd gate line GL1 will be the last voltage present on the respective data lines (DL) as the GL1 gate driving signal transitions to Voff and these captured values will typically be retained for a full frame period. The pixel voltages captured by the pixel-electrodes of the transistors turned on along even gate line GL2 will be the last voltage present on the respective data lines (DL) as the GL2 gate driving signal transitions to Voff and these captured values will typically be retained for a full frame period. The gate-on durations at the Von level of the gate signals $g_n$ and $g_{n+1}/g_{n+1}$ and $g_{n+2}/g_{n+2}$ and $g_{n+3}$ applied to adjacent gate lines (GL1, GL2, GL3, GL4 respectively) overlap one to the next with each other, and more particularly overlap each other for a time span of about 1H. The illustrated gate signals $g_n$ and $g_{n+2}/g_{n+1}$ and $g_{n+3}$ output from the same gate driver 410*a*, 410*b*, 420*a*, and 420*b* can be parts of respective continuously repeated gate line driving signals having a period of one display frame.

As described above, in one embodiment, the gate-on signal Von is maintained high for 1H and longer, for example about 2H such that gate line and/or pixel-electrode pre-charging is performed during the first roughly 1H long time span and such that main-charging of the corresponding pixel-electrodes is performed for the end time period of 1H wherein the new data line voltage Vd is delivered during the end time period of 1H. Accordingly, the charging time made available for each row during a given frame period can be made sufficient for the liquid crystal capacitors even though the number of the gate lines GL to be charged in a same frame period increases.

Figure 5:
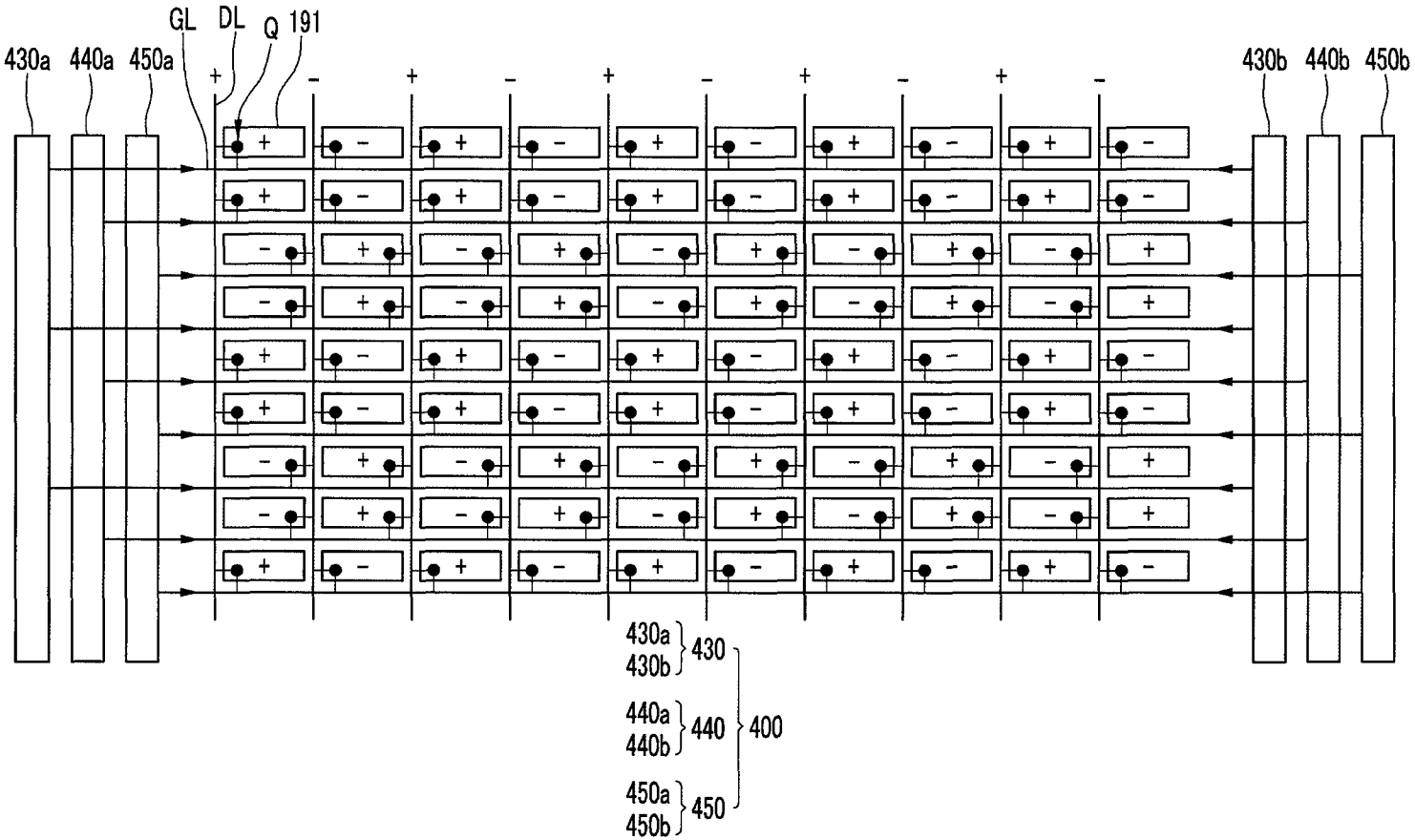
FIG. 5 is a layout view representing arrangement of a pixel and a gate driver for an LCD according to another exemplary embodiment.
Figure 6:
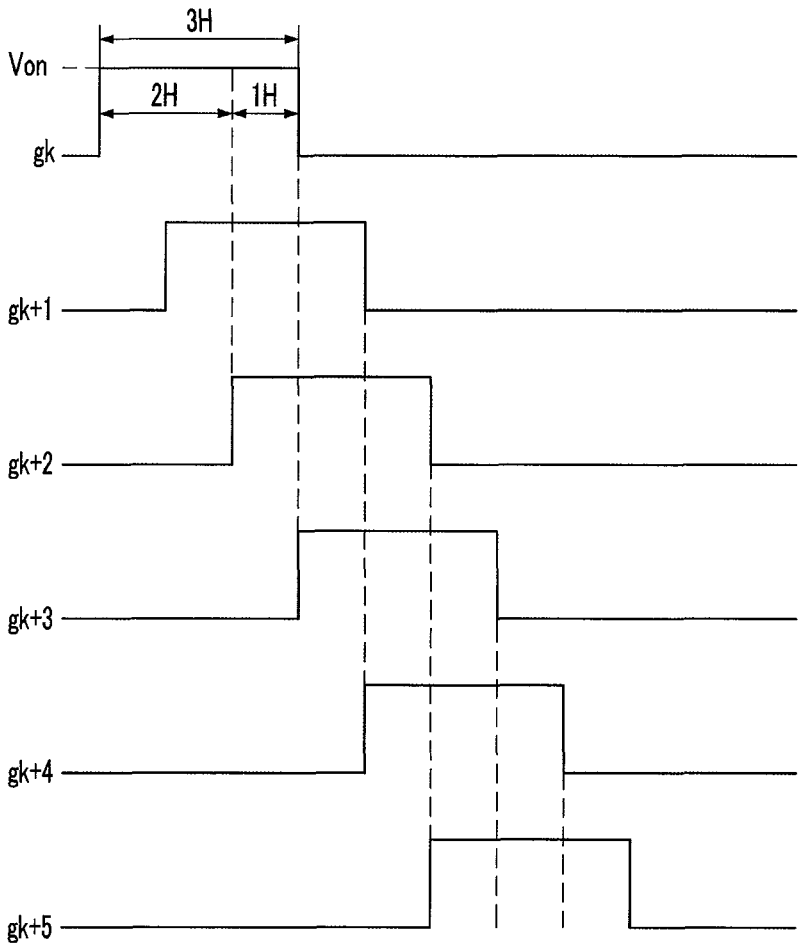
FIG. 6 is a waveform diagram showing a plurality of gate line driving signals being applied over time to sequential ones of gate lines in the liquid crystal display of FIG. 5 where the continuous turn-on levels of the gate line driving signals overlap one to the next with each other over the time line.

Referring to FIGS. 5 and 6, now, the liquid crystal panel assembly 300 and the gate driver 400 according to another embodiment (having an even longer pre-charge time) in accordance with the present disclosure will be described in detail. FIG. 5 is a layout view representing arrangement of a pixel and a gate driver for an LCD according to this other exemplary embodiment.

As shown in FIG. 5, the positions of the pixels, the gate lines GL, the data lines DL, and the thin film transistors Q of the liquid crystal display are substantially the same as those shown in FIG. 3 and interconnections between these elements are substantially the same. Accordingly, a repeated description is omitted here.

However, the subdivision of the gate driver 400 into different gate line driving portions and their respective interconnections to the gate lines of the liquid crystal display shown in FIG. 5 is different from that of the liquid crystal display shown in FIG. 3. More specifically, the gate driver 400 of FIG. 5 includes a third gate driver 430 whose gate line drivers are connected to every third one of the gate lines starting with connection to the first or top gate line (in other words, connected to the 3p+1 gate lines where p=0, 1, 2, etc.). The gate driver 400 of FIG. 5 includes a fourth gate driver 440 whose gate line drivers are connected to every third one of the gate lines starting with connection to the second or next from top gate line (in other words, connected to the 3p+2 gate lines where p=0, 1, 2, etc.). The gate driver 400 of FIG. 5 includes a fifth gate driver 450 whose gate line drivers are connected to every third one of the gate lines starting with connection to the third or second from top gate line (in other words, connected to the 3p+3 gate lines, where p=0, 1, 2, etc.).

In the illustrated embodiment, the third gate driver 430 includes a fifth gate driving circuit portion 430*a* and a spaced-apart sixth gate driving circuit portion 430*b* respectively disposed at or near the left and right sides of the liquid crystal panel assembly 300, respectively. The fifth gate driving circuit 430*a* is connected to output its drive signals to the left end portions of the 3p+1-th gate lines GL, and the sixth gate driving circuit 430*b* is connected to output its drive signals to the right end portions of the 3p+1-th gate lines GL.

The fourth gate driver 440 includes a seventh gate driving circuit portion 440*a* and a spaced-apart eighth gate driving circuit portion 440*b* respectively disposed at or near the left and right sides of the liquid crystal panel assembly 300, respectively as shown. The seventh gate driving circuit portion 440*a* is connected to output its drive signals to the left end portions of the 3p+2-the gate lines GL, and the eighth gate driving circuit portion 440*b* is connected to output its drive signals to the right end portions of the 3p+2-the gate lines GL.

The fifth gate driver 450 includes a ninth gate driving circuit portion 450*a* and a spaced-apart tenth gate driving circuit 450*b* respectively disposed at the left and right sides of the liquid crystal panel assembly 300, respectively. The ninth gate driving circuit portion 450*a* is connected to output its drive signals to the left end portions of the 3p+3-th gate lines GL, and the tenth gate driving circuit portion 450*b* is connected to output its drive signals to the right end portions of the 3p+3-the gate lines GL.

Accordingly, the fifth, the seventh, and the ninth gate driving circuit portions 430*a*, 440*a*, and 450*a* are disposed at or near a first same side of the panel, and the sixth, the eighth, and the tenth gate driving circuit portions 430*b*, 440*b*, and 450*b* are disposed at or near an opposed second side with respect to the liquid crystal panel assembly 300.

Now the gate signals according to the liquid crystal display shown in FIG. 5 will be described in detail with reference to FIG. 6. FIG. 6 is a waveform diagram showing gate driving signals versus time as applied to consecutive ones of gate lines in the liquid crystal display shown in FIG. 5.

Referring to FIG. 6, the gate driver 400 applies the gate line driving signals including the illustrated transitions between a gate-on voltage level, Von and a gate-off voltage level Voff, to respective ones of consecutive gate lines, i.e., GL1, GL2, GL3, GL4, GL5, GL6.

In more detail, the third gate driver 430 applies the gate signals to the 3p+1-th gate lines GL, the fourth gate driver 440 applies the gate signals to the 3p+2-th gate lines GL, and the fifth gate driver 450 applies the gate signals to the 3p+3-th gate lines GL. Here, the fifth gate driving circuit portion 430*a* and the sixth gate driving circuit portion 430*b* of the third gate driver 430 applies the gate signals at the left side and the right side of the 3p+1-th gate lines GL, respectively, the seventh gate driving circuit portion 440*a* and the eighth gate driving circuit portion 440*b* of the fourth gate driver 440 applies the gate signals at the left side and the right side of the 3p+2-th gate lines GL, respectively, and the ninth gate driving circuit portion 450*a* and the tenth gate driving circuit portion 450*b* of the fifth gate driver 450 applies the gate signals at the left side and the right side of the 3p+3-th gate lines GL, respectively.

The reason why drive signal overlap at the Von level is allowable over a consecutive set of gate lines (e.g., GL1-GL6 of FIG. 5) is because left side circuit portion 430*a* can continue to drive odd gate line GL1 at the Von level in the last 1H horizontal scan period of the 3H width of signal gk; this being the time 1H time span when a positive polarity (+) or negative polarity (−) data voltage corresponding to GL1 is being output on the respective data line of each column even while left side circuit portion 440*a* (gk+1) is in the middle of driving even gate line GL2 at the Von level and even as left side circuit portion 450*a* (gk+2) is at the start of driving odd gate line GL3 to the Von level. The pixel voltage captured by the pixel-electrodes of the transistors turned on along the top odd gate line GL1 will be the last voltages present on the respective mono-polarity-per-frame data lines (DL) as the GL1 gate driving signal transitions to Voff and these captured values will typically be retained for a full frame period until the next time the gk waveform repeats. The captured pixel voltages of GL1 serve as pixel-electrode pre-charging voltages for the pixel-electrodes of GL2 whose capture time happens in the next 1H time period. The pixel voltages captured by the pixel-electrodes of the transistors turned on along even gate line GL2 will be the last voltage present on the respective data lines (DL) as the GL2 gate driving signal transitions to Voff in the gk+1 waveform and these captured values will typically be retained for a full frame period. The pixel voltages captured by the pixel-electrodes of the transistors turned on along odd gate line GL3 will be the last voltage present on the respective data lines (DL) as the GL3 gate driving signal transitions to Voff in the gk+2 waveform and these captured values will typically be retained for a full frame period. Since each gate line has a gate and line pre-charging period of about 2H before its final data capture slot of 1H, even if the respective gate lines are very long and have relatively large RC time constants as measured to their midpoints, the gate and line pre-charging period of about 2H should be sufficient to assure a non-delayed, good Von pulse in the final data capture slot of 1H for each row of pixels and accordingly, the signal delay of the gate signals Vg will generally not be a problem even though the gate lines GL are very long as may be the case in a wide screen display situation.

As seen in FIG. 6, the duration of the continuous gate-on signal level, Von is substantially greater than 1H, and is about 3H in the illustrated example. The gate-on signal levels, Von of the gate signals $g_k$ and $g_{k+1}/g_{k+1}$ and $g_{k+2}/g_{k+2}$ and $g_{k+3}/g_{k+3}$ and $g_{k+4}/g_{k+4}$ and $g_{k+5}$ are respectively applied to adjacent gate lines GL1-GL6 so as to chronologically overlap one to the next with each other, and more particularly to overlap one to the next with each other for a pre-charge duration of about 2H.

As described above, the gate-on signal level, Von is maintained for longer than the last 1H capture slot of each row-activating pulse, for example for about 3H so that pre-charging is performed for previous 2H duration and main-charging of the targeted pixel-electrodes is performed in the last 1H slot of each row-activating pulse. Accordingly, a sufficient charging time (the last 1H) is always preserved for the liquid crystal capacitors even though the number of the gate lines GL that are addressed per frame might increase (due to enhancement of vertical display resolution) and thus reduce the initial 3H time allotted to each gate line on a per frame basis.

In the embodiments described above, two or three differently phased gate driver portions are disposed at the same panel side with respect to the ends of the gate lines being driven out of phase, one relative to the next. It is to be understood that the present disclosure is not to be taken as limited to the illustrated examples of just two or three out-of-phase gate line drivers per each side of the display panel. It is within the contemplation of the disclosure to have larger numbers of out-of-phase gate line drivers disposed on the liquid crystal panel.

An embodiment of the liquid crystal panel assembly 300 mentioned above will now be described in greater detail with reference to FIG. 7 to FIG. 9.

Figure 7:
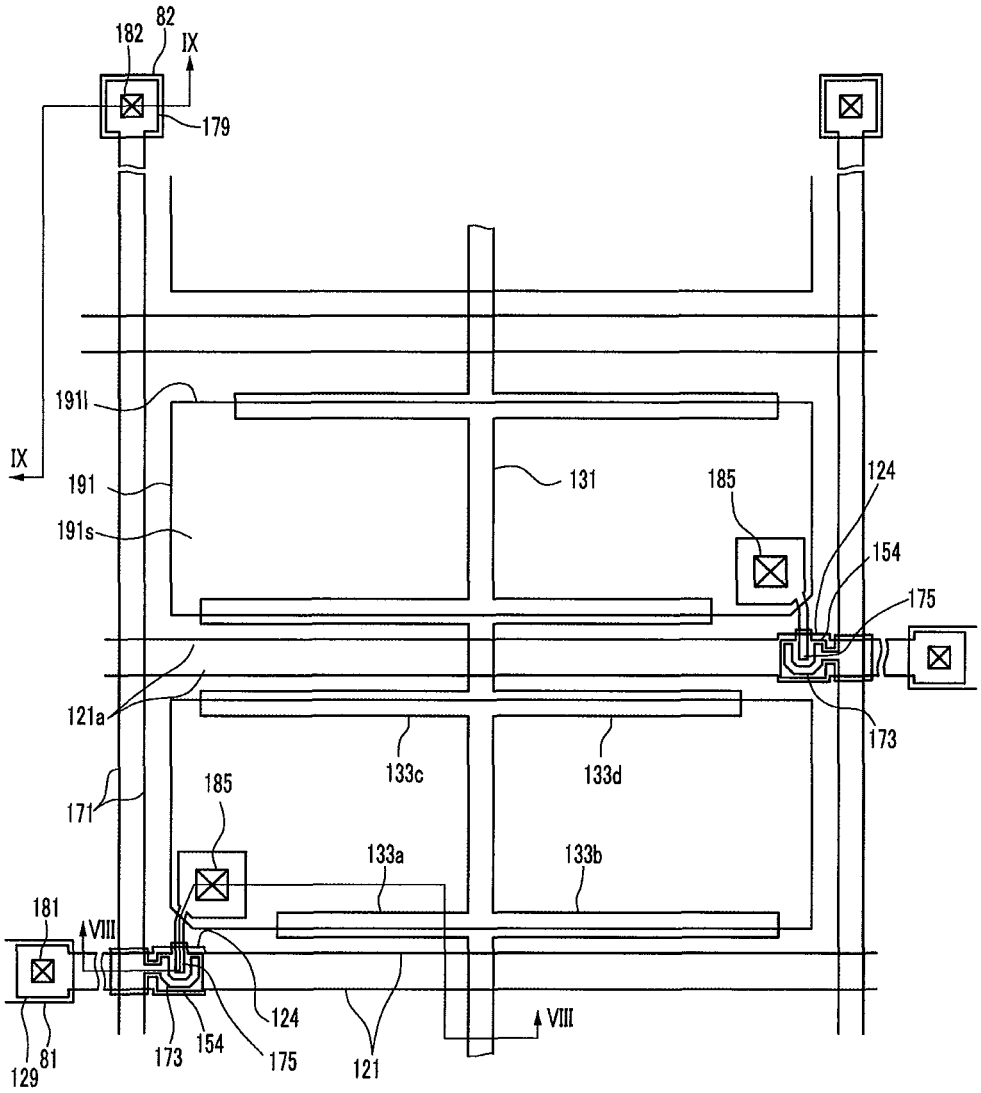
FIG. 7 is a layout view of a liquid crystal panel assembly according to an exemplary embodiment.
Figure 8:
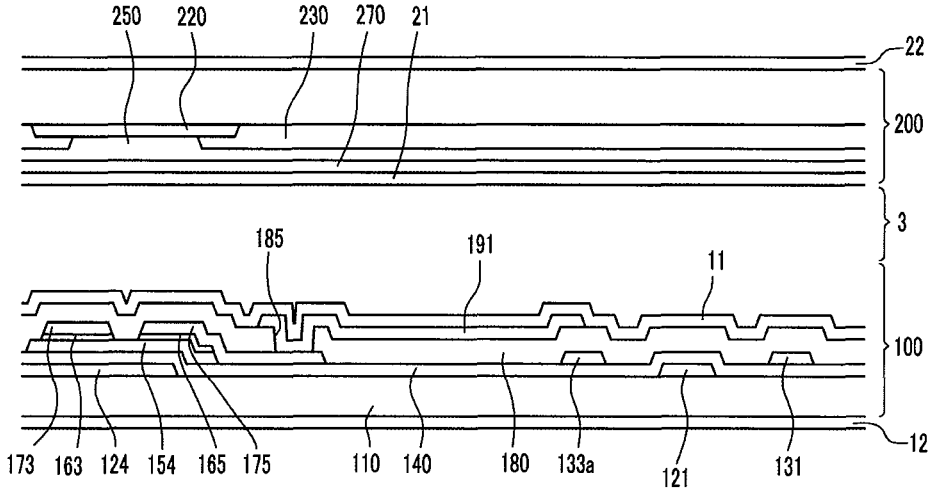
FIG. 8 and FIG. 9 are cross-sectional views of the liquid crystal panel assembly illustrated in FIG. 7 taken respectively along the lines VIII-VIII and IX-IX.
Figure 9:
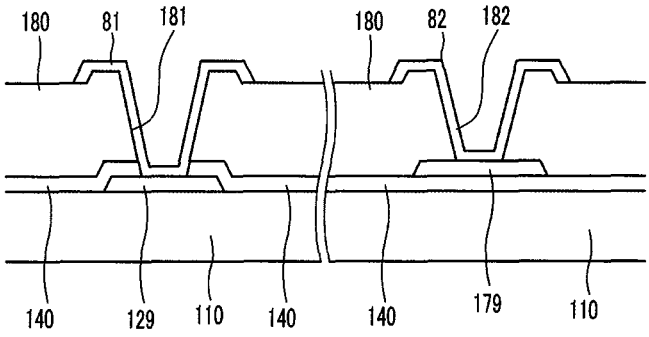

FIG. 7 is a top layout view of a liquid crystal panel assembly according to an exemplary embodiment while FIG. 8 and FIG. 9 are cross-sectional views of the liquid crystal panel assembly illustrated in FIG. 7 taken along the corresponding sectional lines VIII-VIII and IX-IX.

Referring to FIG. 7 to FIG. 9, a liquid crystal panel assembly according to an exemplary embodiment of the present disclosure includes a thin film transistor array panel 100, a common electrode panel 200, and a liquid crystal layer 3 interposed between the two display panels 100 and 200.

First, the thin film transistor array panel 100 will be described in detail. A plurality of electrically conductive gate lines 121 are formed on an insulating substrate 110, where the latter is preferably made of a transparent glass or plastic.

The gate lines 121 for transmitting gate signals extend substantially in a transverse direction. Each gate line 121 may include a plurality of integral gate electrodes 124 that protrude upward or downward from the gate line and an end portion 129 having a large area for connection by way of an interconnect via with another layer or an external driving circuit.

The gate lines 121 may be made of an aluminum- (Al) containing metal such as Al and an Al alloy, a silver- (Ag) containing metal such as Ag and a Ag alloy, a copper- (Cu) containing metal such as Cu and a Cu alloy, a molybdenum- (Mo) containing metal such as Mo and a Mo alloy, chromium (Cr), tantalum (Ta), and titanium (Ti). Alternatively, the gate lines 121 may have a multi-layered structure including two conductive layers (not shown) having different physical properties. One of the two conductive layers is preferably made of a low resistivity metal such as an Al-containing metal, an Ag-containing metal, or a Cu-containing metal for reducing signal delay or voltage drop.

In one embodiment, the lateral sidewalls of the gate lines 121 are inclined relative to a major surface of the substrate 110, and the preferable inclination angle thereof ranges from about 30 degrees to about 80 degrees.

A gate insulating layer 140 such as made of a silicon nitride (SiNx) or a silicon oxide (SiOx) is formed on the gate lines 121.

A plurality of semiconductor islands 154 such as made of hydrogenated amorphous silicon (abbreviated to "a-Si") or polysilicon are formed on the gate insulating layer 140. Each semiconductor 154 is disposed on the gate electrode 124.

A plurality of ohmic contact islands 163 and 165 are formed on the semiconductors 154. The ohmic contacts 163 and 165 may be made of n+ hydrogenated a-Si heavily doped with an n-type impurity such as phosphorus (P), or silicide. The ohmic contacts 163 and 165 are disposed in pairs on the semiconductor 154.

In one embodiment, the lateral sidewalls of the semiconductors 154 and the ohmic contacts 163 and 165 are also inclined relative to a surface of the substrate 110, and the inclination angle thereof ranges from about 30 degrees to about 80 degrees.

A plurality of data lines 171, a plurality of drain electrodes 175, and a plurality of storage electrode lines 131 are formed on the ohmic contacts 163 and 165 and the gate insulating layer 140.

The data lines 171 for transmitting data signals extend substantially in the longitudinal direction and thus intersect orthogonally with the gate lines 121. Each data line 171 includes a plurality of source electrodes 173 branched out toward the gate electrodes 124 and an end portion 179 having a large area for connection with another layer or an external driving circuit. The data driving circuit (not shown) for generating analog data signals may be mounted on a flexible printed circuit film (not shown) attached to the substrate 110, it may be directly mounted on the substrate 110, or it may be integrated with the substrate 110. When the data driving circuit is integrated on the substrate 110, the data lines 171 may be extended to be directly connected to such a data driving circuit.

Each drain electrode 175 is separated from the data line 171 and opposes a source electrode 173 with respect to a gate electrode 124. Each drain electrode 175 has an end portion having a large area and another stick-shaped end portion, and the stick-shaped end portion is partially surrounded by the source electrode 173 that is curved in the shape of a letter U as shown. The source electrode 173 and the drain electrode 175 substantially have bilateral symmetry.

A gate electrode 124, a source electrode 173, and a drain electrode 175, along with a semiconductor 154, form a thin film transistor (TFT) having a channel formed in the semiconductor 154 disposed between the source electrode 173 and the drain electrode 175.

The storage electrode lines 131 are supplied with a predetermined voltage such as the common voltage, and each of the storage electrode lines 131 includes a stem extending substantially parallel to the data lines 171 and a plurality of storage electrodes 133*a*, 133*b*, 133*c* and 133*d* branched out from the stem. The storage electrodes 133*a*-133*d* extend parallel with the gate lines 121 to both sides from the stem and are close by the gate lines 121. However, the shapes and dispositions of the storage electrode lines 131 may be modified in various ways if desired.

The data lines 171, the drain electrodes 175, and the storage electrode lines 131 may be made of a refractory metal such as Mo, Cr, Ta, and Ti or an alloy thereof, and they may have a multi-layered structure including a refractory metal layer (not shown) and a conductive layer (not shown) having low resistivity. An example of the multi-layered structure includes a double-layered structure including a lower Cr or Mo (alloy) layer and an upper Al (alloy) layer, and a triple-layered structure including a lower Mo (alloy) layer, an intermediate Al (alloy) layer, and an upper Mo (alloy) layer. However, the data lines 171, the drain electrodes 175, and the storage electrode lines 131 may be made of many various metals or conductive materials besides the above.

In one embodiment, the lateral sidewalls of the data lines 171, the drain electrodes 175, and the storage electrode lines 131 are also inclined relative to a surface of the substrate 110, and the inclination angles thereof are preferably in a range of about 30 degrees to about 80 degrees.

The ohmic contacts 163 and 165 are interposed only between the underlying semiconductors 154 and the overlying data lines 171 and the drain electrodes 175 thereon, and reduce the contact resistance therebetween. The semiconductor 154 includes exposed portions which are not covered with the data line 171 and the drain electrode 175 such as the portion located between the source electrode 173 and the drain electrode 175.

A passivation layer 180 is formed on the data lines 171, the drain electrodes 175, and the exposed portions of the semiconductors 154. The passivation layer 180 is made of an inorganic insulator such as silicon nitride or silicon oxide. Alternatively, the passivation layer 180 may be made of an organic insulator, and the surface thereof may be flat. The organic insulator may have photosensitivity, and the relative dielectric constant thereof may be kept lower than about 4.0. Moreover, the passivation layer 180 may have a double-layered structure including a lower inorganic layer and an upper organic layer in order to not harm the exposed portions of the semiconductors 154 and to make the most of the excellent insulating characteristics of an organic layer.

The passivation layer 180 has a plurality of contact holes 182 and 185 respectively exposing the end portions 179 of the data lines 171 and the drain electrodes 175, and the passivation layer 180 and the gate insulating layer 140 have a plurality of contact holes 181 exposing the end portions 129 of the gate lines 121.

A plurality of pixel electrodes 191, a plurality of connecting members 81, and a plurality of contact assistants 82 are formed on the passivation layer 180. These elements may be made of a transparent conductive material such as ITO and IZO, or a reflective metal such as Al, Ag, Cr, or an alloy thereof.

Each pixel electrode 191 has four major edges that are substantially parallel to the gate lines 121 or the data lines 171. Among these edges, the length of the two transverse edges 191*l* that are parallel to the gate lines 121 is longer than, substantially by for example three times the length of the two longitudinal edges 191*s* that are parallel to the data lines 171. Consequently, compared to the case in which the transverse edges are shorter than the longitudinal edges, the number of pixel electrodes 191 located in each row is smaller, and the number of pixel electrodes 191 located in each column is greater. Accordingly, since the number of all the data lines 171 is decreased relative to pixel height, the material cost can be reduced by decreasing the number of IC chips for the data driver 500. Even though the number of gate lines 121 is increased, since the gate driver 400 can be integrated into the assembly 300 along with the gate lines 121, data lines 171, and the TFTs, the increase of the number of gate lines 121 is not a substantial cost problem. Moreover, even if the gate driver 400 is mounted in the form of IC chips, it is more advantageous to decrease the number of IC chips for the data driver 500 because the cost of the IC chips for the gate driver 400 is relatively low.

The pixel electrode 191 is physically and electrically connected with the drain electrode 175 through the contact hole 185, and receives a data voltage from the drain electrode 175. The pixel electrode 191 applied with a data voltage generates an electric field in cooperation with the common electrode 270 on the common electrode panel 200 supplied with a common voltage so that the orientations of the liquid crystal molecules in the liquid crystal layer 3 interposed between the two electrodes 191 and 270 are determined. In accordance with the determined orientations of the liquid crystal molecules, the polarization of light passing through the liquid crystal layer 3 is varied. A pixel electrode 191 and the common electrode 270 form a liquid crystal capacitor to store and preserve the applied voltage even after the TFT is turned off.

The pixel electrode 191 overlaps the storage electrode line 131 including the storage electrodes 133*a*-133*d* to form a storage capacitor that enhances the voltage storing capacity of the liquid crystal capacitor. In detail, the stem of the storage electrode line 131 traverses across the middle of the pixel electrode 191 in a longitudinal direction, and the top and bottom boundaries of the pixel electrode 191 are located on the storage electrodes 133*a*-133*d* extending to the right and left from the stem. If the storage electrode line 131 is disposed in this way, electromagnetic crosstalk interference between the gate line 121 and the pixel electrode 191 is blocked or shielded against by the presence of the interposed storage electrodes 133*a*-133*d*, thereby stably maintaining a captured voltage on the pixel electrode 191. Also, in this structure, the length of conducting wire in the longitudinal direction is less compared to the structure in which the storage electrodes 133*a*-133*d* are disposed at the left and right boundaries of the pixel electrode 191, and thus the transverse width of pixels is reduced such that sufficient space for integrating gate driver 400 can be ensured. Also, the storage electrodes 133*a*-133*d* help to block light leakage between the pixel electrodes 191. A step difference caused by disposing the stem of the storage electrode line 131 in the middle of the pixel electrode 191 can be compensated for by making the inclination of the lateral sidewalls of the storage electrode line 131 gentle.

Each contact assistant 82 is connected to the end portion 179 of the data line 171 through the contact hole 182. The contact assistants 82 supplement the adhesive property of the end portions 179 of the data lines 171 to exterior devices, and protect them.

Each connecting member 81 is connected to an end portion 129 of the gate line 121 through the contact hole 181. The connecting members 81 connect the end portions 129 of the gate lines 121 to the gate driver 400. If the gate driver 400 is in the form of IC chips, the connecting members 81 may have similar shapes and functions to the contact assistants 82.

Next, the upper panel 200 will be described in detail.

A light blocking member 220 is formed on an insulating substrate 210 where the latter is preferably made of transparent glass or plastic. The light blocking member 220 is also called a black matrix, and it prevents light leakage in areas between the pixels.

A plurality of color filters 230 are also formed on the substrate 210 and the light blocking member 220. The color filters 230 are disposed substantially in the regions enclosed by the light blocking member 220, and may extend along a transverse direction substantially along the rows of pixel electrodes 191. Each of the color filters 230 may represent one of the primary colors such as three primary colors of red, green, and blue.

An overcoat 250 is formed on the color filters 230 and the light blocking member 200. The overcoat 250 may be made of an organic insulator, and it prevents the color filters 230 from being exposed and provides a flat surface. The overcoat 250 may be omitted.

Alignment layers 11 and 21 are coated on inner surfaces of the panels 100 and 200, and they may be vertical alignment layers. Polarizers 12 and 22 are provided on outer surfaces of the panels 100 and 200, and their polarization axes may be parallel or perpendicular to each other. One of the two polarizers may be omitted when the LCD is a reflective LCD.

An LCD according to the present exemplary embodiment may further include a retardation film (not shown) for compensating the retardation of the liquid crystal layer 3. The LCD may further include a backlight unit (not shown) for supplying light to the polarizers 12 and 22, the retardation film, the panels 100 and 200, and the liquid crystal layer 3.

The liquid crystal layer 3 may be in a state of positive or negative dielectric anisotropy, and the liquid crystal molecules in the liquid crystal layer 3 are aligned such that their long axes are substantially parallel or vertical to the surfaces of the panels 100 and 200 in the absence of an electric field.

According to the embodiments of the present disclosure, the number of data driving circuit chips installed in an LCD may be reduced and an excessive delay of display device driving signals may be prevented. Thereby, image qualities for large size LCD may be improved.

While this disclosure provides what are presently considered to be practical exemplary embodiments, it is to be understood that the disclosure is not to be taken as limited to the disclosed embodiments, but, on the contrary, it is intended to cover various modifications and equivalent arrangements included within the spirit and scope of the supplied teachings.

What is claimed is:

1. A liquid crystal display comprising:

a substrate;

a plurality of gate lines formed on the substrate;

a plurality of data lines crossing the gate lines;

a plurality of thin film transistors connected to the gate lines and the data lines;

a plurality of pixel electrodes connected to the thin film transistors; and at least three gate drivers each exclusively connected to a respective subset of the gate lines, the at least three gate drivers including a first gate driver, a second gate driver, and a third gate driver, wherein the first gate driver includes a first portion disposed on a first side of the liquid crystal display and a second portion disposed on a second side of the liquid crystal display, the second side being opposite to the first side, wherein the second gate driver includes a third portion disposed on the first side of the liquid crystal display and a fourth portion disposed on the second side of the liquid crystal display, wherein the third gate driver includes a fifth portion disposed on the first side of the liquid crystal display and a sixth portion disposed on the second side of the liquid crystal display, wherein the first portion and the second portion of the first gate driver are electrically connected to a first gate line, the third portion and the fourth portion of the second gate driver are electrically connected to a second gate line, and the fifth portion and the sixth portion of the third gate driver are electrically connected to a third gate line, wherein the first portion and the second portion of the first gate driver are further electrically connected to a fourth gate line, the third portion and the fourth portion of the second gate driver are further electrically connected to a fifth gate line, and the fifth portion and the sixth portion of the third gate driver are further electrically connected to a sixth gate line, wherein the second gate line and the third gate line are disposed between the first gate line and the fourth gate line in a layout view of the liquid crystal display, and wherein the fifth gate line is disposed between the fourth gate line and the sixth gate line in the layout view of the liquid crystal display, wherein the gate lines are supplied with gate signals including a gate-on voltage and a gate-off voltage, and the gate-on voltage is maintained for 3 horizontal periods.

2. The liquid crystal display of claim 1, wherein the at least three gate drivers are configured to output out-of-phase turn-on pulses to their respective subsets of the gate lines.

3. The liquid crystal display of claim 2, wherein the gate lines are supplied with gate signals including a gate-on voltage and a gate-off voltage, and the gate-on voltage is maintained for 1 horizontal period or more.

4. The liquid crystal display of claim 3 wherein the gate-on voltage is maintained for at least 2 horizontal periods.

5. The liquid crystal display of claim 4, wherein the durations of the gate-on voltages of two gate voltages applied to two gate lines adjacent to each other overlap each other.

6. The liquid crystal display of claim 5, wherein the durations of the gate-on voltages of two gate voltages applied to two gate lines adjacent to each other overlap each other for at least 1 horizontal period.

7. The liquid crystal display of claim 1, wherein the first portion and the second portion of the first gate driver are electrically connected to two opposite ends of the first gate line, the third portion and the fourth portion of the second gate driver are electrically connected to two opposite ends of the second gate line, and the fifth portion and the sixth portion of the third gate driver are electrically connected to two opposite ends of the third gate line.

8. The liquid crystal display of claim 7, wherein the first to third gate drivers are sequentially connected to the different gate lines, respectively.

9. The liquid crystal display of claim 1, wherein the gate drivers are located in the same layer as the gate lines, the data lines, and the thin film transistors.

10. The liquid crystal display of claim 1, wherein the thin film transistors adjacent to each other in a column direction are connected to the different data lines respectively every two rows.

11. The liquid crystal display of claim 1, wherein the durations of the gate-on voltages of two gate voltages applied to two gate lines adjacent to each other overlap each other for at least 1 horizontal period.

12. The liquid crystal display of claim 1, wherein the durations of the gate-on voltages of two gate voltages applied to two gate lines adjacent to each other overlap each other for 2 horizontal periods.

13. The liquid crystal display of claim 1, wherein a data voltage applied to one of the data lines has a fixed polarity.

14. The liquid crystal display of claim 1, wherein the pixel electrodes have a first edge parallel to the gate line and a second edge that is shorter than the first edge and is next to the first edge.

15. The liquid crystal display of claim 14, wherein the length of the first edge is three times the length of the second edge.

16. A method of timely providing a gate turn-on level to respective gates of a first row of thin film transistors of a liquid crystal display and then to an adjacent second row by way of corresponding and adjacent first and second gate lines, the method comprising:

using a first gate lines driver unit to supply the gate turn-on level to at least a first end of the first gate line during a first pre-charge time span immediately preceding a corresponding and predefined data voltage supplying first time slot and continuing to supply the gate turn-on level for a time extending into the predefined data voltage supplying first time slot, wherein the gate turn-on level supplied by the first gate lines driver unit has a duration greater than a horizontal line scan period that is associated with a synchronization signal, and wherein the first pre-charge time span has a duration greater than the horizontal line scan period;

during said predefined data voltage supplying first time slot, supplying, on a first data line that crosses the first gate line, a corresponding first pixel-driving data voltage of a given first polarity;

during the first pre-charge time span, supplying on said first data line a pixel pre-charging voltage of the same given first polarity.

17. The method of claim 16 wherein the gate turn-on level is also injected into the first end of the second gate line to serve as a pre-charge for a time extending into a predefined data voltage supplying second time slot.

18. The method of claim 16 wherein the gate turn-on level is also injected into an opposite second end of the first gate line to serve as a pre-charge for a time extending into the predefined data voltage supplying first time slot.

19. The method of claim 16 further comprising, during said predefined data voltage supplying first time slot, using a second gate lines driver unit to supply the gate turn-on level to at least a first end of the next adjacent gate line.

* * * * *